United States Patent [19]

Noda

[11] 4,309,799

[45] Jan. 12, 1982

[54] BELT HOLDING DEVICE

[75] Inventor: Taizo Noda, Nishinomiya, Japan

[73] Assignee: Kohshoh Limited, Kyoto, Japan

[21] Appl. No.: 59,438

[22] Filed: Jul. 20, 1979

[30] Foreign Application Priority Data

Aug. 26, 1978 [JP] Japan ..... 53-104288

[51] Int. Cl.[3] ..... A44B 11/00

[52] U.S. Cl. ..... 24/315; 2/321; 2/328; 2/336; 24/200; D2/409

[58] Field of Search ..... 24/74 A, 198, 200, 315; 2/321, 322, 326, 328, 336; D2/409, 410

[56] References Cited

U.S. PATENT DOCUMENTS

D. 162,932 4/1951 Burnham ..... D2/409
244,776 7/1881 Wales ..... 24/198
2,260,060 10/1941 Shaulson ..... 24/200

FOREIGN PATENT DOCUMENTS 326071 3/1930 United Kingdom ..... 24/264
709133 5/1954 United Kingdom ..... 24/200

*Primary Examiner*—Roy D. Frazier
*Assistant Examiner*—Alexander Grosz

[57] ABSTRACT

A belt holding device formed integrally from a continuous and planar blank material and comprising a peripheral frame portion and at least three projections or tongued portions respectively extending from the peripheral frame portion toward generally a center of a central area defined by the peripheral frame portion, and leaving an opening in generally a center of the central area through which a strip of belt can be threaded in position.

4 Claims, 7 Drawing Figures

BELT HOLDING DEVICE

BACKGROUND OF THE INVENTION

The present invention relates to an improved belt holding device for holding a belt such as a slacks or pants suspender belt, a book binding belt, etc. in diagonal or crossed manner.

According to the prior art, a typical construction of this type of belt holding device has hitherto been generally used such that there are provided three independently formed openings or slits for threading a suspending belt therethrough defined in the peripheral portion of a web of isosceles triangle shape made of a piece of such material as a metal plate.

In the conventional construction of such type of belt holding device, there are usually equipped with a manually detouchable fixture or clip on a free end of each of such suspender belt in order to securely connect the belt end to a waist rim part of a pair of slacks or pants. Therefore, with such construction of the conventional belt holding device, when fabricating a strip of belt to the holding device, it was essential to once remove the belt-end fixture from the belt prior to such fabrication job, to thread the belt through the belt holding device, and then to have the fixture fixed on the belt again. As a consequence, in such fabrication work, it would inevitably be a troublesome job to set the belt-end fixture with each leg of the belt being held in a crossed or diagonal relationship with each other through the belt holding device, and also it would be a nerve-taking job to have a long stretch of belt threaded through the openings or slits of the belt holding device. Moreover, there is a possibility that either side or face of the belt would be damaged by frictional effect as rendered while being threaded through the belt holding device openings by the edge portions thereof.

SUMMARY OF THE INVENTION

It is therefore a primary object of the present invention to provide an improved and useful belt holding device to operatively hold each leg of belt in diagonal or crossed relationship with each other from slipping out of a holding point.

It is another object of the invention to provide an improved and useful belt holding device which can provide for a substantially simplified fabrication work of such as a slacks suspender belt assembly.

It is still another object of this invention to provide an improved and useful belt holding device through which a belt-end fixture or clip is allowed to be threaded as it is left at a belt-end during a fabrication work.

It is a further object of this invention to provide an improved and useful belt holding device in which a fabrication work may be practiced with a minimum extent of damage while being threaded therethrough during a fabrication work.

According to the present invention essentially directed to attain the objects as mentioned above, there is provided an improved and useful belt holding device formed integrally in one piece from a continuous and planar blank material, and comprising in combination a peripheral frame surrounding a central area and at least three projections or tongues extending from the peripheral frame toward generally a center of the central area, the central area being formed with an opening in a center thereof for allowing a strip of belt to pass threthrough, a plurality of corresponding in number to said projections of elongated openings or slits being defined extending in communication with said central opening between the peripheral frame and the projections and adapted to alow at least one leg of the strip of belt to thread therethrough.

A belt holding device according to this invention may, by way of one aspect thereof, be formed of any of such continuous and planar materials of plate form as metal, synthetic plastic resin, and wood which can be appropriately selected in consideration of their strength in use, touch or feeling in use, workability, etc. Also, with respect to a thickness of the material plate for the belt holding device, it is preferred that it is made as thin as practically possible, as long as it has a sufficient strength available, in order to present a smooth and comfortable feeling in use. More particularly, it is preferred that every portion of the belt holding device where the belt dowels or rests in contact or comes nearby is made with a substantial thinness in comparison with other portions thereof in accordance with a thickness of the belt to be used therewith so that it may provide a further flat and comfortable feeling while in use resulted from a less extent of looping or deflection at and around each point of contact with the belt.

According to another aspect of this invention, a general configuration of a frame portion of the belt holding device may generally be designed in any of triangle, square, pentagon, hexagon, septagon, or octagon, most preferably in either pentagon or hexagon. On the other hand, an area defined by the frame portion mentioned above may be generally configured accordingly in a similarity with the shape of the outer frame portion, there being integrally formed a plurality of projections or tongues extending toward generally a center of the holding device from the frame portion and leaving an opening or clearance in generally center of the central area through which a strip of belt can be threaded in position.

By way of a preferred embodiment, the plurality of projections or tongues may be three in number, and in another preferred embodiment thereof they may be four in number. It is advantageous that these projections or tongues are of a tapered shape in such a manner that they increase in their transversal width or breadth as they extend toward the central area of the holding device, so that they may engage in catching or holding effect with the belt to be threaded therethrough. In this embodiment, the plurality of projections or tongues extend in a substantially trapezoidal shape in their respect plan views. Furthermore, the configuration of these projections or tongues may be a sector by way of a further embodiment with an equivalent effect to positively hold the belt in a desired position.

In such construction of the belt holding device formed from the planar material and comprising the frame portion and the plurality of projections, there are provided a plurality of openings or slits for threading the belts therethrough between either side of an adjacent pair of projections to positively catch the belts. Each of the openings or slits is formed with, for instance, such a narrow and elongated configuration that it may snugly pass a strip of belt therethrough in accordance with a given breadth of the belt and that it may correspond to a given degree of inclination or orientation of each leg of the belt to extend therethrough.

In addition to such application, the belt holding device according to this invention may of course be applied to such general use wherein each leg of belt is held either in a crossing or diagonal relationship with each other for use in suspending slacks around one's waist, binding books together, packing general freight as a unit, etc.

The foregoing objects, characteristics, principle, and details of the present invention, as well as further objects and advantages thereof, will become more apparent from the following detailed description when read in conjunction with accompanying drawings, in which like parts are designated with like reference numerals.

DETAILED DESCRIPTION OF THE PREFERRED EMBODIMENT

Description is now given with respect to typical embodiments of this invention in connection with accompanying drawings, however, it is to be understood that these embodiments are essentially for illustrative purpose only, but not in any way for restriction thereto.

Figure 1:
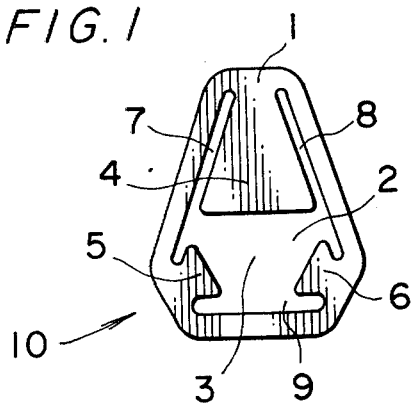
FIG. 1 is a plan view showing a belt holding device by way of a first preferred embodiment of the present invention.

Referring firstly to FIG. 1, there is shown a plan view of a belt holding device by way of a first embodiment of this invention, wherein the belt holding device comprises a peripheral frame 1 defined in generally hexagonal shape and three projections or tongues 4, 5 and 6 extending from the peripheral frame 1 toward generally a center of a central area 2 surrounded by the peripheral frame 1 and adapted to positively hold, for instance, a slacks suspending belt in a desired position and in a crossed or angled relationship, there being defined a clearance or opening 3 in generally a center of the central area 2 and adapted to allow the belt to pass therethrough. The peripheral frame 1 and the tongues or projections 4, 5 and 6 are formed integrally or a in a single piece from a planar and continuous sheet materials such as polycarbonate, nylon, or acetatecopolymer, more preferably of polycarbonate in a preferred embodiment of the invention. Each of the tongues 4, 5 and 6 is formed in such a tapered fashion that it increases in its breadth as it extends from the peripheral frame 1 toward generally the center of the central area 2, thus each forming a substantially trapezoidal shape as viewed in plan thereof.

Among elongated and narrow openings or slits 7, 8 and 9 as defined by the peripheral frame 1 and each of the tongues 4, 5 and 6 extending from alternate or every other side of the frame 1 of hexagonal shape, or in other words, defined between the lateral sides of an adjacent pair of the tongues, the slit 9 is specially formed with such a substantially wider breadth than those of the slits 7 and 8 that it may allow two strips of belts to pass together therethrough. On the other hand, the slits 7 and 8 are formed to be substantially longer than the length of the slit 9 such that they may allow a single strip of belt to pass in a slant or inclined fashion therethrough, respectively.

Figure 2:
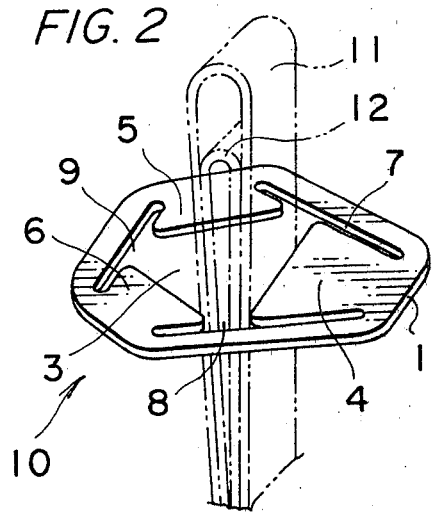
FIG. 2 is a perspective view for explaining the manner of inserting a strip of belt through the belt holding device shown in FIG. 1.
Figure 3:
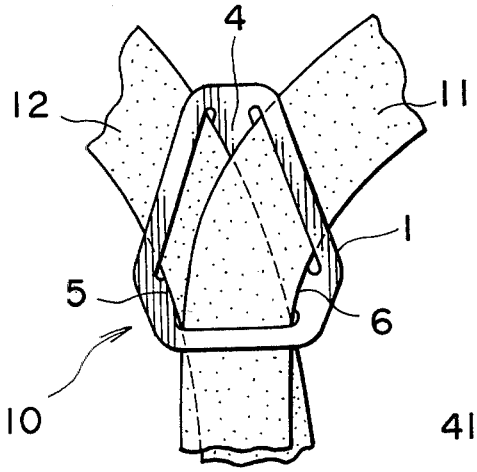
FIG. 3 is a plan view showing the state that two strips of slacks suspending belts are threaded through the belt holding device shown in FIG. 1.

Next, referring to FIGS. 2 and 3 given is description on the manner how to insert or thread a strip of suspending belt through the belt holding device 10 of the construction as stated hereinbefore. In the first place, two strips of belts 11 and 12 are folded together or in a stacked relationship one upon another, each of which belts is fixed with a belt-end fixture or clip at the opposite ends thereof, respectively, and then inserted together through the opening 3 of the belt holding device 10 as typically shown in FIG. 2. Thereafter, one pair of legs or one single-layered wing of stacked belts are threaded through the slit 8, and the other pair of legs of stacked belts are put through the slit 7, respectively, in a slant or diagonal fashion so that each of thus-threaded belts 11, 12 in each of the slits can now be ready for being pulled respectively in its each extending direction, thus resulting in a desired diagonal holding position at and through the belt holding device 10.

With such unique construction of the belt holding device 10 according to this invention, it is so advantageous that two strips of suspending belts 11, 12 with the belt-end clipsat the individual ends thereof may readily be fabricated into the belt holding device, which can substantially facilitate and simplify a manual fixation job of the belt-end clips onto the belt ends to a great extent. More specifically, by virtue of advantageous features of the present belt holding device 10, since it is no longer necessary to thread a free end of the strip of belt through such a thin or narrow slit with delicate manual job prior to the fabrication of the belt holding device on the belts, it will substantially contribute to simplification of the manual job in the fabrication of the belt holding device onto the strip of belts, whereby the surface or edges of the belt may effectively be protected from being damaged as experienced during such fabrication job in the case of the conventional construction.

Figure 4:
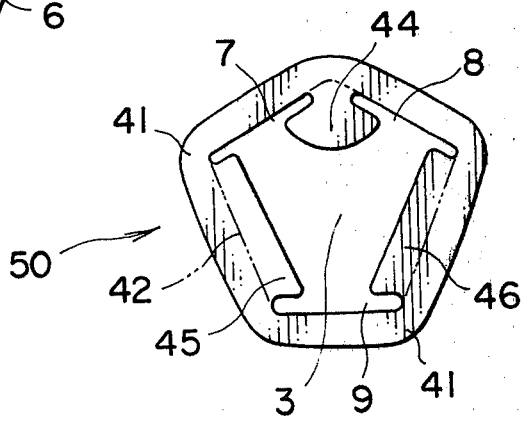
FIG. 4 is a plan view showing a second preferred embodiment of the invention.

Now, with respect to FIG. 4, there is shown another embodiment of the present invention wherein a belt holding device 50 is provided with a peripheral frame 41 of generally pentagonal shape. In this construction, an area 42 is defined in pentagonal shape by the frame 41, and provided with three projections 44, 45 and 46 extending from the frame 41. Among these projections, the projection 44 extending from one apex or corner of the frame 41 of pentagonal shape is specifically formed in sector as viewed in plan. With such construction of the belt holding device 50, it is practicably possible to readily fabricate the device onto two strips of belts 11, 12 with the belt-end fixtures attached priorly at the individual ends thereof with quite an ease as much as the case of the first example of the invention as stated hereinbefore.

Figure 5:
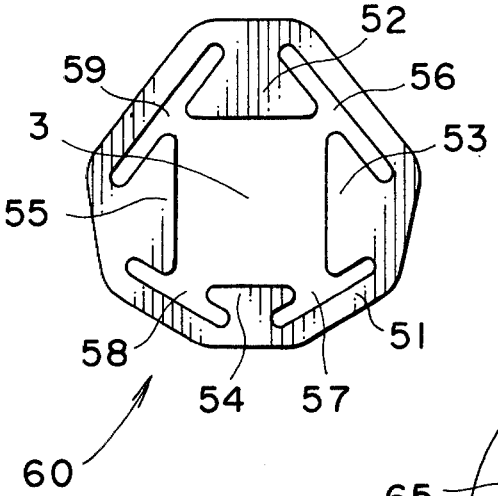
FIGS. 5 and 6 are plan views showing further embodiments of the invention.

Furthermore, as typically shown in FIG. 5, a third embodiment of the invention may be made available wherein a belt holding device 60 is provided with an outer frame 51 of octagonal shape, and wherein there are provided four projections 52, 53, 54 and 55 for catching the belt in the area of generally octagonal shape defined by the frame 51 and extending from every other sides of the frame 51. With such arrangement, a single stretch of belt is inserted through each of four slits 56, 57, 58 and 59 for catching the belt which is formed in intercommunication with the central opening 3 and are respectively defined between the frame 51 and the projections 52, 53, 54 and 55.

Figure 6:
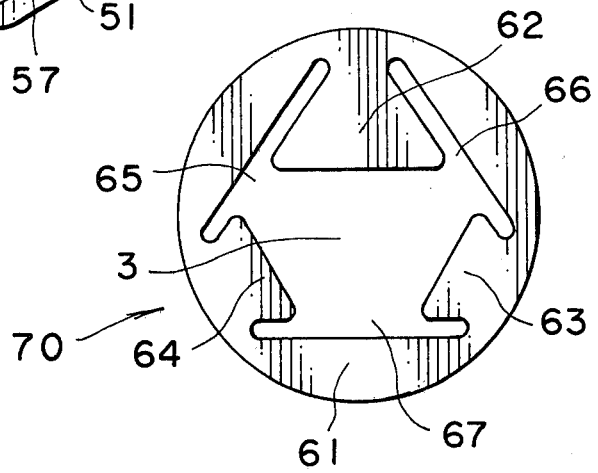

Also, as shown in FIG. 6, a belt holding device 70 may be formed in a circle form as defined by a frame 61 wherein there may be three or four projections. In this preferred embodiment, three projections 62, 63 and 64 extend from the frame 61 in a circle-shaped area defined by the frame 61. In the case of such embodiment where the general configuration of the frame 61 is circle, it is preferred that each of slits for threading a strip of belt therethrough, i.e. 65, 66 and 67 defined between the frame 61 and the projections 62, 63 and 64 is formed in a straight fashion, instead of being in accordance with the curvature of the frame configuration so as to have the belt rest snugly thereon.

Figure 7:
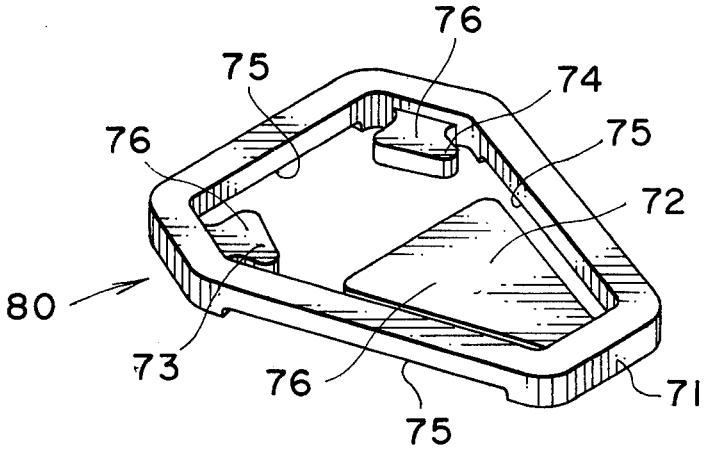
FIG. 7 is a perspective view showing a still further embodiment of the invention wherein there are portions made substantially thinner in thickness where the belts dowel or rest than the remaining portions of the belt holding device.

As typically shown in FIG. 7, as a further embodiment of this invention, it is advantageous that there is provided a belt holding device 80 wherein leg portions 75 of a frame 71 and tongue-shaped extension 76 of projections 72, 73 and 74 where a strip of belt closely contact with and rest on may be made substantially thinner than other framing parts. With such particular configuration of the belt holding device 80, no deflection or looping is allowed at and around the points of the belt holding device where the belt comes in rest or close contact with, whereby a smooth and comfortable feeling is assured in use.

What is claimed is:

1. A belt holding device formed integrally in one piece from a continuous and planar blank, comprising a peripheral frame defining an inner area having an opening in the center thereof for allowing a belt with legs to pass in crossed relationship therethrough and three projections extending from said frame toward generally the center of said inner area, three elongated slits extending in the inner area along the frame in communication with said central opening, each of said slits extending between two adjacent projections and adapted to allow at least one leg of said belt to thread therethrough, said inner area being formed in the form of a pentagon, one of said projections extending from one corner of said pentagon and having an arcuate inner edge and a pair of converging straight edges extending toward said one corner, each of other projections extending from each of alternate sides of said pentagon defined between other corners thereof and having a substantially trapezoidal shape in plan view, portions of said belt holding device which are contacted by the legs of the belt being formed with a thickness substantially thinner than the thickness of remaining portions of said device, thereby allowing said device to hold belt with legs in crossed relationship.

2. A belt holding device formed integrally in one piece from a continuous and planar blank, comprising a peripheral frame defining an inner area having an opening in the center thereof for allowing a belt with legs to pass in cross relationship therethrough and four projections extending from said frame toward generally the center of said inner area, four elongated slits extending in the inner area along the frame in communication with said central opening, each of said slits extending between two adjacent projections and adapted to allow one leg of said belt to thread therethrough, said inner area being formed in the form of an octagon, each of said projections extending from each of alternate sides of said octagon, at least one of said projections being formed in a substantially trapezoidal shape in plan view, thereby allowing said device to hold said belt with legs in crossed relationship.

3. The belt holding device as claimed in claim 2, wherein portions of said belt holding device which are contacted by the legs of the belt are formed with a thickness substantially thinner than the thickness of remaining portions of said device.

4. A belt holding device formed integrally in one piece from a continuous and planar blank, comprising a peripheral frame defining an inner area having an opening in the center thereof for allowing a belt with legs to pass in cross relationship therethrough and three projections extending from said frame toward generally the center of said inner area, three elongated slits extending in the inner area along the frame in communication with said central opening, each of said slits extending between two adjacent projections and adapted to allow at least one leg of said belt to thread therethrough, said inner area being formed in the form of a hexagon, each of said projections extending from each of alternate sides of said hexagon, said projections being formed in a substantially trapezoidal shape in plan view, and portions of said belt holding device which are contacted by the legs of the belt being formed with a thickness substantially thinner than the thickness or remaining portions of said device thereby allowing said device to hold said belt with legs in crossed relationship.

* * * * *